US011125092B2

(12) United States Patent
Ponchak et al.

(10) Patent No.: US 11,125,092 B2
(45) Date of Patent: Sep. 21, 2021

(54) GAS TURBINE ENGINE HAVING CANTILEVERED STATORS

(71) Applicant: UNITED TECHNOLOGIES CORPORATION, Farmington, CT (US)

(72) Inventors: Jeffrey D. Ponchak, North Berwick, ME (US); Alex Daniel Morrow, Arundel, ME (US); Charles H. Warner, South Portland, ME (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 170 days.

(21) Appl. No.: 16/103,462

(22) Filed: Aug. 14, 2018

(65) Prior Publication Data

US 2020/0056495 A1 Feb. 20, 2020

(51) Int. Cl.
*F01D 11/18* (2006.01)
*F01D 11/00* (2006.01)

(52) U.S. Cl.
CPC ..... *F01D 11/001* (2013.01); *F01D 11/18* (2013.01)

(58) Field of Classification Search
CPC ..... F01D 11/001; F01D 11/18; F01D 25/246; F01D 9/042
See application file for complete search history.

(56) References Cited

U.S. PATENT DOCUMENTS 2,812,159 A * 11/1957 Krebs ..... F01D 9/042 415/119
5,022,818 A * 6/1991 Scalzo ..... F04D 29/542 415/209.3
5,131,813 A * 7/1992 Przytulski ..... F01D 9/042 416/217
5,195,868 A * 3/1993 Plemmons ..... F01D 25/145 29/525.02
5,201,846 A * 4/1993 Sweeney ..... F01D 9/04 415/170.1

(Continued)

FOREIGN PATENT DOCUMENTS

EP 1548232 A1 6/2005
EP 3244016 A2 11/2017
WO 2018118217 A2 6/2018

OTHER PUBLICATIONS

European Search Report Application No. Issued EP19191795, dated Dec. 10, 2019; pp. 9.

*Primary Examiner* — Justin D Seabe
*Assistant Examiner* — Theodore C Ribadeneyra
(74) *Attorney, Agent, or Firm* — Cantor Colburn LLP

(57) ABSTRACT

A gas turbine engine includes a case assembly and a stator segment. The case assembly defines a first slot having a first surface and a second surface. The stator segment includes a shroud body axially extends between a first body end and a second body end. A first flange extends into the first slot. The first flange has a first flange first side, a first flange second side, a first flange first surface and a first flange second surface each circumferentially extending between the first flange first side and the first flange second side. A first portion of the first flange first surface engages the first surface. A second portion of the first flange first surface. A third portion of the first flange first surface is spaced apart from the first surface.

20 Claims, 2 Drawing Sheets

(56) References Cited

U.S. PATENT DOCUMENTS

| | | | | |
|---|---|---|---|---|
| 5,205,708 | A | 4/1993 | Plemmons et al. | |
| 5,562,408 | A * | 10/1996 | Proctor | F01D 11/24 415/173.1 |
| 6,062,813 | A * | 5/2000 | Halliwell | F01D 9/04 415/173.1 |
| 6,863,497 | B2 | 3/2005 | Seydel et al. | |
| 7,448,846 | B2 | 11/2008 | Ruthemeyer et al. | |
| 7,452,183 | B2 * | 11/2008 | Ruthemeyer | F01D 11/005 415/135 |
| 8,961,125 | B2 * | 2/2015 | Chuong | F01D 9/042 415/209.2 |
| 2006/0153683 | A1 * | 7/2006 | Dube | F01D 25/246 416/220 R |
| 2007/0031244 | A1 * | 2/2007 | Ruthemeyer | F01D 11/005 415/134 |
| 2008/0193290 | A1 | 8/2008 | Brackett et al. | |
| 2015/0267547 | A1 * | 9/2015 | Guemmer | F01D 9/041 415/209.1 |
| 2016/0169025 | A1 * | 6/2016 | Lamusga | F01D 11/08 415/173.1 |

* cited by examiner

GAS TURBINE ENGINE HAVING CANTILEVERED STATORS

BACKGROUND

A gas turbine engine may include a fan section, a compressor section, a combustor section, and a turbine section. The compressor section and the turbine section typically may include stator assemblies that are interspersed between rotating airfoils. The stator assemblies may include a plurality of vanes supported between upper and lower platforms. Some of the stator assemblies may have life limiting locations that may decrease the part's low cycle fatigue life.

SUMMARY

Disclosed is a gas turbine engine that includes a case assembly and a stator segment. The case assembly is disposed about a central longitudinal axis of the gas turbine engine and defines a first slot having a first surface and a second surface. The stator segment includes a shroud body and a first flange. The shroud body axially extends between a first body end and a second body end. The first flange extends from the first body end and into the first slot. The first flange has a first flange first side and a first flange second side disposed opposite the first flange first surface, a first flange first surface and a first flange second surface each circumferentially extending between the first flange first side and the first flange second side. A first portion of the first flange first surface proximate the first flange first side engages the first surface. A second portion of the first flange first surface proximate the first flange second side engages the first surface. A third portion of the first flange first surface that is disposed between the first portion of the first flange first surface and the second portion of the first flange first surface is spaced apart from the first surface.

In addition to one or more of the features described above, or as an alternative to any of the foregoing embodiments, engagement between the first portion of the first flange first surface and the first surface defines a first interference fit.

In addition to one or more of the features described above, or as an alternative to any of the foregoing embodiments, engagement between the second portion of the first flange first surface and the first surface defines a second interference fit.

In addition to one or more of the features described above, or as an alternative to any of the foregoing embodiments, the first interference fit and the second interference fit applies a spring load to the first flange.

In addition to one or more of the features described above, or as an alternative to any of the foregoing embodiments, a first portion of the first flange second surface proximate the first flange first side is spaced apart from the second surface, a second portion of the first flange second surface proximate the first flange second side is spaced apart from the second surface, and a third portion of the first flange second surface that is disposed between the first portion of the first flange second surface and the second portion of the first flange second surface engages the second surface.

In addition to one or more of the features described above, or as an alternative to any of the foregoing embodiments, the first slot has a first slot end surface that radially extends between distal ends of the first surface and the second surface.

In addition to one or more of the features described above, or as an alternative to any of the foregoing embodiments, the first flange has a flange end surface that faces towards the first slot end surface, the flange end surface extends between ends of the first flange first side, the first flange second side, the first flange first surface, and the first flange second surface.

In addition to one or more of the features described above, or as an alternative to any of the foregoing embodiments, the flange end surface is axially spaced apart from the first slot end surface.

Also disclosed is a portion of a gas turbine engine that includes a case assembly and a stator segment. The case assembly is disposed about a central longitudinal axis of the gas turbine engine and defines a first slot having a first radius of curvature that circumferentially extends about the case assembly. The stator segment includes a first flange that extends from a first body end of a shroud body and into the first slot. The first flange has a first flange first side and a first flange second side disposed opposite the first flange first surface, a first flange first surface and a first flange second surface circumferentially each extending between the first flange first side and the first flange second side. The first flange has a second radius of curvature that circumferentially extends between the first flange first side and the first flange second side. The second radius of curvature being less than the first radius of curvature.

In addition to one or more of the features described above, or as an alternative to any of the foregoing embodiments, the first radius of curvature is radially offset from the second radius of curvature.

In addition to one or more of the features described above, or as an alternative to any of the foregoing embodiments, the first slot has a first surface and a second surface, each disposed parallel to the central longitudinal axis.

In addition to one or more of the features described above, or as an alternative to any of the foregoing embodiments, a first portion of the first flange first surface proximate the first flange first side engages the first surface, a second portion of the first flange first surface proximate the first flange second side engages the first surface, and a third portion of the first flange first surface that is disposed between the first portion of the first flange first surface and the second portion of the first flange first surface is spaced apart from the first surface.

In addition to one or more of the features described above, or as an alternative to any of the foregoing embodiments, the case assembly defines a second slot that is disposed opposite the first slot.

In addition to one or more of the features described above, or as an alternative to any of the foregoing embodiments, the second slot has a third surface and a fourth surface, each disposed parallel to the central longitudinal axis.

In addition to one or more of the features described above, or as an alternative to any of the foregoing embodiments, the first surface and the third surface are disposed parallel but not coplanar to each other.

In addition to one or more of the features described above, or as an alternative to any of the foregoing embodiments, the stator further comprising a second flange that extends from a second body end of the shroud body that is disposed opposite the second body end.

In addition to one or more of the features described above, or as an alternative to any of the foregoing embodiments, the second flange is radially offset from the first flange.

In addition to one or more of the features described above, or as an alternative to any of the foregoing embodiments, the second flange extends into the second slot.

In addition to one or more of the features described above, or as an alternative to any of the foregoing embodiments, the second flange has a second flange first side and a second flange second side disposed opposite the second flange first surface, a second flange first surface and a second flange second surface each circumferentially extending between the second flange first side and the second flange second side.

In addition to one or more of the features described above, or as an alternative to any of the foregoing embodiments, a first portion of the second flange first surface proximate the second flange first side engages the third surface, a second portion of the second flange first surface proximate the second flange second side engages the third surface, and a third portion of the second flange first surface that is disposed between the first portion of the second flange first surface and the second portion of the second flange first surface is spaced apart from the third surface.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

A detailed description of one or more embodiments of the disclosed apparatus and method are presented herein by way of exemplification and not limitation with reference to the Figures.

Figure 1:
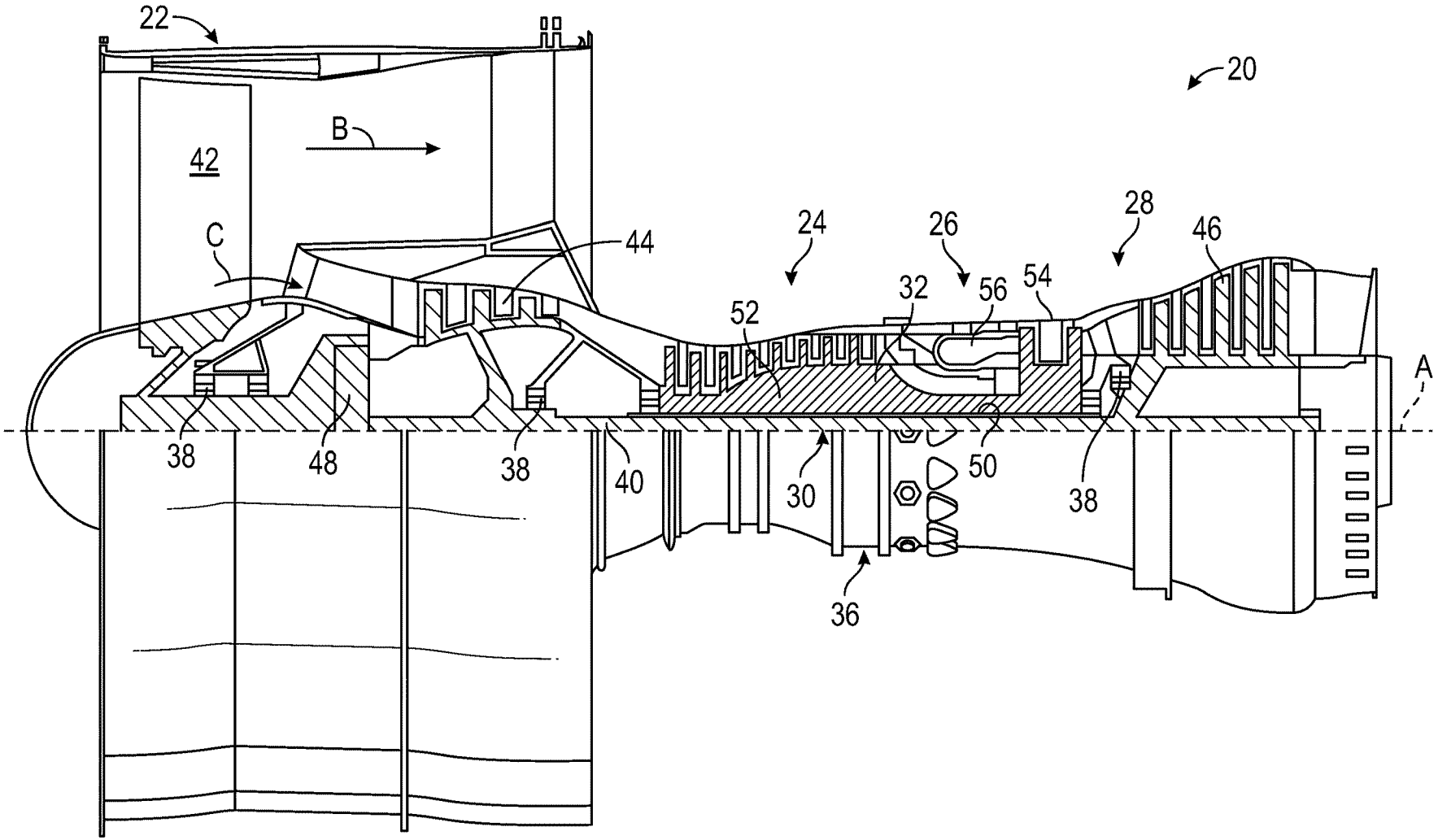
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of

[(Tram ° R)/(518.7° R)]0.5. The "Low corrected fan tip speed" as disclosed herein according to one non-limiting embodiment is less than about 1150 ft/second (350.5 m/sec).

The compressor section 24 or the turbine section 28 may include at least a portion of a case assembly 60 of the gas turbine engine 20 that at least partially supports a stator array or stator segments 62. The stator array or stator segments 62 may loaded into the case assembly 60 and a tangential space may be defined between adjacent stator segments 62.

The case assembly 60 is disposed about the central longitudinal axis A. The case assembly 60 defines a first slot 70 and a second slot 72 that is disposed opposite the first slot 70.

The first slot 70 includes a first surface 80, a second surface 82 that is spaced apart from the first surface 80, and a first slot end surface 84. The first surface 80 and the second surface 82 are disposed generally parallel to the central longitudinal axis A. The first slot end surface 84 radially extends, with respect to the central longitudinal axis A, between distal ends of the first surface 80 and the second surface 82.

The first surface 80 of the first slot 70 has a first radial height, h1, relative to the central longitudinal axis A. The second surface 82 of the first slot 80 has a second radial height, h2, relative to the central longitudinal axis A. The second radial height, h2, is greater than the first radial height, h1.

The first slot 70 has a first radius of curvature, r1, which circumferentially extends about the case assembly 60 and about the central longitudinal axis A.

The second slot 72 is axially spaced apart from the first slot 70, with respect to the central longitudinal axis A. The second slot 72 includes a third surface 90, a fourth surface 92 that is spaced apart from the third surface 90, and a second slot end surface 94. The third surface 90 is disposed generally parallel to the first surface 80 but not coplanar with the first surface 80. The third surface 90 and the fourth surface 92 are disposed generally parallel to the central longitudinal axis A. The fourth surface 92 is disposed generally parallel to but not coplanar with the second surface 82. In at least one embodiment, a step or a transition surface 96 extends between the fourth surface 92 and the second surface 82. The second slot end surface 94 radially extends between distal ends of the third surface 90 and the fourth surface 92. The second slot end surface 94 is disposed generally parallel to the first slot end surface 84.

The second slot 72 has a radius of curvature that is substantially equal to the first radius of curvature, r1. The radius of curvature of the second slot 72 circumferentially extends about the case assembly 60 and about the central longitudinal axis A.

Figure 2:
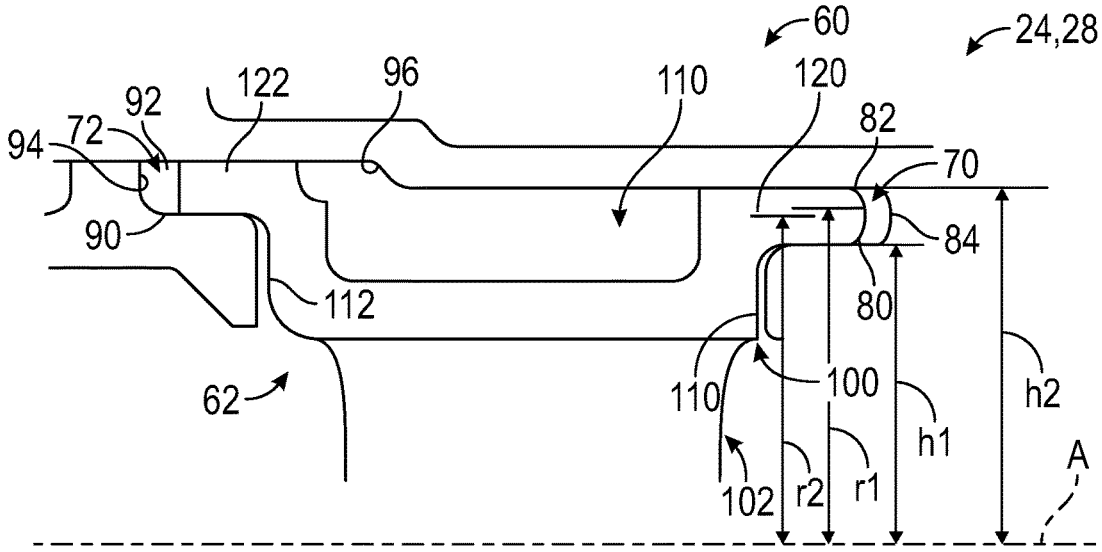
FIG. 2 is a partial sectional view of a stator vane segment of the gas turbine engine.

The stator segment 62 may include stator vane segments that are cantilever mounted at an outer diameter of the case assembly 60, as shown in FIG. 2. The stator vane segments may be coupled to a common shroud or independent shrouds.

The stator segment 62 includes a shroud body 100 and an airfoil 102 that radially extends from the shroud body 100 towards the central longitudinal axis A. The shroud body 100 may be an outer diameter shroud or an outer diameter platform that is secured to the case assembly 60 via the first slot 70 and/or the second slot 72, such that the stator segment 62 is cantilevered.

The shroud body 100 axially extends between a first body end 110 and a second body end 112. In at least one embodiment, the shroud body 100 defines a lug receiving area or an anti-rotation slot 114 that radially extends towards the central longitudinal axis A and is disposed between the first body end 110 and the second body end 112.

The shroud body 100 includes a first flange 120 that axially extends from the first body end 110 into the first slot 70 and a second flange 122 that axially extends from the second body end 112 extends into the second slot 72. An entirety of a radially outermost surface to the shroud body 100 is disposed radially inboard of a radially innermost surface of the first slot 70, relative to the central longitudinal axis A.

Figure 3:
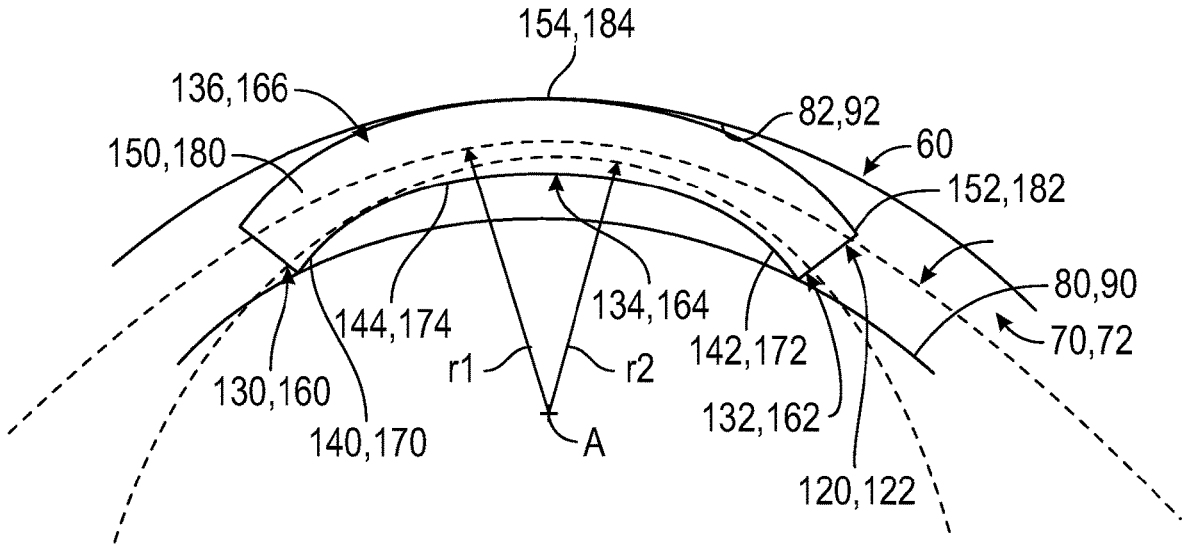
FIG. 3 is an end view of a portion of the stator vane segment of the gas turbine engine.

Referring to FIGS. 2 and 3, the first flange 120 includes a first flange first side 130, a first flange second side 132, a first flange first surface 134, a first flange second surface 136, and a first flange end surface 138. The first flange second side 132 is disposed opposite the first flange first side 130. The first flange first surface 134 is spaced apart from the first flange second surface 136. First flange first surface 134 and the first flange second surface 136 each circumferentially extend between the first flange first side 130 and the first flange second side 132. The first flange end surface 138 extends between ends of the first flange first side 130, the first flange second side 132, the first flange first surface 134, and the first flange second surface 136. The first flange end surface 138 faces towards the first slot end surface 84 and is axially spaced apart from the first slot end surface 84.

The first flange 120 has a second radius of curvature, r2, which circumferentially extends between the first flange first side 130 and the first flange second side 132. The second radius of curvature, r2, of the first flange 120 is less than the first radius of curvature, r1, of the first slot 70. The first radius of curvature, r1, of the first slot 70 is radially offset from the second radius of curvature, r2, such that the first flange 120 has a curl wherein the first flange first surface 134 and the first flange second surface 136 bows/curls towards second surface 82 of the first slot 70.

The curl of the first flange 120 towards the second surface 82 of the first slot 70 is such that a first portion 140 of the first flange first surface 134 proximate the first flange first side 130 engages the first surface 80 to define a first interference fit, a second portion 142 of the first flange first surface 134 proximate the first flange second side 132 engages the first surface 80 to define a second interference fit, and a third portion 144 of the first flange first surface 134 that is disposed between the first portion 140 of the first flange first surface 134 and the second portion 142 of the first flange first surface 134 is spaced apart from the first surface 80 of the first slot 70. The engagement between the first portion 140 of the first flange first surface 134 and the first surface 80 of the first slot 70, the engagement between the second portion 142 of the first flange first surface 134 and the first surface 80 of the first slot 70, and the spacing apart of the third portion 144 of the first flange first surface 134 from the first surface 80 of the first slot 70 are shown in an exaggerated condition in FIG. 3.

The curl of the first flange 120 towards the second surface 82 of the first slot 70 is such that a first portion 150 of the first flange second surface 136 proximate the first flange first side 130 is spaced apart from the second surface 82 of the first slot 70, a second portion 152 of the first flange second surface 136 proximate the first flange second side 132 is spaced apart from the second surface 82 of the first slot 70, and a third portion 154 of the first flange second surface 136 that is disposed between the first portion 150 and the second portion 152 of the first flange second surface 136 engages the second surface 82 of the first slot 70. The engagement of the third portion 154 of the first flange second surface 136 with the second surface 82 of first slot 70, the spacing apart of the first portion 150 of the first flange second surface 136 from the second surface 82 of the first slot 70, and the spacing apart of the second portion 152 of the first flange second surface 136 and the second surface 82 of the first slot 70 are shown in an exaggerated condition in FIG. 3.

The curl of the first flange 120 that results in the first interference fit and the second interference fit, imposes or applies a spring load to the first flange 120 such that compressive stresses on the shroud body 100 increase to improve the low cycle fatigue life of the stator segment 62 due to the bending/deflection.

Referring to FIGS. 2 and 3, the second flange 122 includes a second flange first side 160, a second flange second side 162, a second flange first surface 164, a second flange second surface 166, and a second flange end surface 168. The second flange second side 162 is disposed opposite the second flange first side 160. The second flange first surface 164 is spaced apart from the second flange second surface 166. The second flange first surface 164 and the second flange second surface 166 each circumferentially extend between the second flange first side 160 and the second flange second side 162. The second flange end surface 168 extends between ends of the second flange first side 160, the second flange second side 162, the second flange first surface 164, and the second flange second surface 166. The second flange end surface 168 faces towards the second slot end surface 94 and is axially spaced apart from the second slot end surface 94.

The second flange 122 also has the second radius of curvature, r2, which circumferentially extends between the second flange first side 160 and the second flange second side 162. The second radius of curvature, r2, of the second flange 122 is less than the first radius of curvature, r1, of the second slot 72. The first radius of curvature, r1, of the second slot 72 is radially offset from the second radius of curvature, r2, such that the second flange 122 has a curl wherein the second flange first surface 164 and the second flange second surface 166 bows/curls towards the fourth surface 92 of the second slot 72.

The curl of the second flange 122 towards the fourth surface 92 of the second slot 72 is such that a first portion 170 of the second flange first surface 164 proximate the second flange first side 160 engages the third surface 90 to define a first interference fit, a second portion 172 of the second flange first surface 164 proximate the second flange second side 162 engages the third surface 90 to define a second interference fit, and a third portion 174 of the second flange first surface 164 that is disposed between the first portion 170 of the second flange first surface 164 and the second portion 172 of the second flange first surface 164 is spaced apart from the third surface 90 of the second slot 72. The engagement between the first portion 170 of the second flange first surface 164 and the third surface 90 of the second slot 72, the engagement between the second portion 172 of the second flange first surface 164 and the third surface 90 of the second slot 72, and the spacing apart of the third portion 174 of the second flange first surface 164 from the third surface 90 of the second slot 72 is shown in an exaggerated condition in FIG. 3.

The curl of the second flange 122 towards the fourth surface 92 of the second slot 72 is such that a first portion 180 of the second flange second surface 166 proximate the second flange first side 160 is spaced apart from the fourth surface 92 of the second slot 72, a second portion 182 of the second flange second surface 166 proximate the second flange second side 162 is spaced apart from the fourth surface 92 of the second slot 72, and a third portion 184 of the second flange second surface 166 that is disposed between the first portion 180 and the second portion 182 of the second flange second surface 166 engages the fourth surface 92 of the second slot 72. The engagement of the third portion 184 of the second flange second surface 166 with the fourth surface 92 of second slot 72, the spacing apart of the first portion 180 of the second flange second surface 166 from the fourth surface 92 of the second slot 72, and the spacing apart of the second portion 182 of the second flange second surface 166 and the fourth surface 92 of the second slot 72 is shown in an exaggerated condition in FIG. 3.

The curl of the second flange 122 that results in the first interference fit and the second interference fit, imposes or applies a spring load to the second flange 122 such that compressive stresses on the shroud body 100 increase to improve the low cycle fatigue life of the stator segment 62 due to the bending/deflection.

The interference fit at the circumferential edges of the first flange 120 and/or the second flange 122 with the respective slots within which they are received, (e.g. the first slot 70 and the second slot 72) functions as a preload on the first flange 120 and/or the second flange 122. The circumferential interference may vary based on the axial position of the stator segment 62.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A gas turbine engine comprising:

a case assembly disposed about a central longitudinal axis of the gas turbine engine, the case assembly defining a first slot having a first surface and a second surface, the second surface located radially outboard of the first surface; and a stator segment, comprising:

one or more airfoils, each airfoil having an airfoil first axial end and an airfoil second axial end, a shroud body that axially extends between a first body end and a second body end, the one or more airfoils extending radially inwardly from the shroud body, and a first flange that extends from the first body end and into the first slot, the first flange having a first flange first side and a first flange second side disposed opposite the first flange first side, a first flange first surface and a first flange second surface each circumferentially extending between the first flange first side and the first flange second side, a first portion of the first flange first surface proximate the first flange first side engages the first surface, a second portion of the first flange first surface proximate the first flange second side engages the first surface, and a third portion of the first flange first surface that is disposed between the first portion of the first flange first surface and the second portion of the first flange first surface is spaced apart from the first surface;

wherein the first flange is non-concentric with the first slot; and wherein an entirety of a radially outboard surface of the shroud body is disposed radially inboard of the first surface and the second surface, relative to the central longitudinal axis;

wherein the second surface includes a radial step between the airfoil first axial end and the airfoil second axial end.

2. The gas turbine engine of claim 1, wherein engagement between the first portion of the first flange first surface and the first surface defines a first interference fit.

3. The gas turbine engine of claim 2, wherein engagement between the second portion of the first flange first surface and the first surface defines a second interference fit.

4. The gas turbine engine of claim 3, wherein the first interference fit and the second interference fit applies a spring load to the first flange.

5. The gas turbine engine of claim 1, wherein a first portion of the first flange second surface proximate the first flange first side is spaced apart from the second surface, a second portion of the first flange second surface proximate the first flange second side is spaced apart from the second surface, and a third portion of the first flange second surface that is disposed between the first portion of the first flange second surface and the second portion of the first flange second surface engages the second surface.

6. The gas turbine engine of claim 1, wherein the first slot has a first slot end surface that radially extends between distal ends of the first surface and the second surface.

7. The gas turbine engine of claim 6, wherein the first flange has a flange end surface that faces towards the first slot end surface, the flange end surface extends between ends of the first flange first side, the first flange second side, the first flange first surface, and the first flange second surface.

8. The gas turbine engine of claim 7, wherein the flange end surface is axially spaced apart from the first slot end surface.

9. A portion of a gas turbine engine, comprising:

a case assembly disposed about a central longitudinal axis of the gas turbine engine, the case assembly defining a first slot having a first radius of curvature that circumferentially extends about the case assembly, the first slot defined by a first surface and a second surface located radially outboard of the first surface; and a stator segment, comprising:

one or more airfoils, each airfoil having an airfoil first axial end and an airfoil second axial end, a first flange that extends from a first body end of a shroud body and into the first slot, the first flange having a first flange first side and a first flange second side disposed opposite the first flange first side, a first flange first surface and a first flange second surface circumferentially each extending between the first flange first side and the first flange second side, the first flange having a second radius of curvature that circumferentially extends between the first flange first side and the first flange second side, the second radius of curvature being less than the first radius of curvature;

wherein the first flange is non-concentric with the first slot;

wherein an entirety of a radially outermost surface to the shroud body is disposed radially inboard of a radially innermost surface of the first slot, relative to the central longitudinal axis;

wherein the one or more airfoils extend radially inwardly from the shroud body, and wherein the second surface includes a radial step between the airfoil first axial end and the airfoil second axial end.

10. The portion of the gas turbine engine of claim 9, wherein the first radius of curvature is radially offset from the second radius of curvature.

11. The portion of the gas turbine engine of claim 9, wherein the first slot has a first surface and a second surface, each disposed parallel to the central longitudinal axis.

12. The portion of the gas turbine engine of claim 11, wherein a first portion of the first flange first surface proximate the first flange first side engages the first surface, a second portion of the first flange first surface proximate the first flange second side engages the first surface, and a third portion of the first flange first surface that is disposed between the first portion of the first flange first surface and the second portion of the first flange first surface is spaced apart from the first surface.

13. The portion of the gas turbine engine of claim 9, wherein the case assembly defines a second slot that is disposed opposite the first slot.

14. The portion of the gas turbine engine of claim 13, wherein the second slot has a third surface and a fourth surface, each disposed parallel to the central longitudinal axis.

15. The portion of the gas turbine engine of claim 14, wherein the first surface and the third surface are disposed parallel but not coplanar to each other.

16. The portion of the gas turbine engine of claim 14, wherein the stator further comprising a second flange that extends from a second body end of the shroud body that is disposed opposite the second body end.

17. The portion of the gas turbine engine of claim 16, wherein the second flange is radially offset from the first flange.

18. The portion of the gas turbine engine of claim 16, wherein the second flange extends into the second slot.

19. The portion of the gas turbine engine of claim 18, wherein the second flange has a second flange first side and a second flange second side disposed opposite the second flange first surface, a second flange first surface and a second flange second surface each circumferentially extending between the second flange first side and the second flange second side.

20. The portion of the gas turbine engine of claim 19, wherein a first portion of the second flange first surface proximate the second flange first side engages the third surface, a second portion of the second flange first surface proximate the second flange second side engages the third surface, and a third portion of the second flange first surface that is disposed between the first portion of the second flange first surface and the second portion of the second flange first surface is spaced apart from the third surface.

* * * * *